US007484742B2

(12) United States Patent
Choi

(10) Patent No.: US 7,484,742 B2
(45) Date of Patent: Feb. 3, 2009

(54) CASTER SKATE APPARATUS

(75) Inventor: Ynok Choi, Incheon Metropolitan City (KR)

(73) Assignee: Tasem Co., Ltd., Ansan-Si (KR)

( * ) Notice: Subject to any disclaimer, the term of this patent is extended or adjusted under 35 U.S.C. 154(b) by 193 days.

(21) Appl. No.: 11/572,557

(22) PCT Filed: Dec. 2, 2005

(86) PCT No.: PCT/KR2005/004091

§ 371 (c)(1),
(2), (4) Date: Jan. 23, 2007

(87) PCT Pub. No.: WO2006/059883

PCT Pub. Date: Jun. 8, 2006

(65) Prior Publication Data

US 2007/0284835 A1 Dec. 13, 2007

(30) Foreign Application Priority Data

Dec. 3, 2004 (KR) ..... 20-2004-0034401 U

(51) Int. Cl.
*A63C 17/01* (2006.01)

(52) U.S. Cl. ..... 280/87.042; 280/87.041; 280/87.021; 280/87.01; 280/23.1; 280/32.6; 280/11.1

(58) Field of Classification Search ..... 280/87.042, 280/87.041, 87.021, 87.01, 23.1, 32.6, 11.1
See application file for complete search history.

(56) References Cited

U.S. PATENT DOCUMENTS

| | | | | |
|---|---|---|---|---|
| 2,819,907 | A * | 1/1958 | Thoresen | 280/7.13 |
| 4,076,267 | A | 2/1978 | Lipscomb | |
| 4,082,306 | A | 4/1978 | Sheldon | |
| 4,460,187 | A * | 7/1984 | Shimizu | 280/842 |
| 5,540,455 | A | 7/1996 | Chambers | |
| 7,083,178 | B2 * | 8/2006 | Potter | 280/87.042 |
| 7,338,056 | B2 * | 3/2008 | Chen et al. | 280/87.042 |

FOREIGN PATENT DOCUMENTS

KR 100394848 8/2003

* cited by examiner

*Primary Examiner*—Christopher Ellis
*Assistant Examiner*—Cynthia F. Collado
(74) *Attorney, Agent, or Firm*—IPLA P.A.; James E. Bame

(57) ABSTRACT

Disclosed herein is a caster skate apparatus to be propelled in a direction changeable manner by use of rider's both feet. The apparatus comprises front and rear boards (20, 30) to support both feet thereon, first and second rollers (22, 23) mounted to the underside of the front board at front and rear locations by a predetermined distance, third and fourth rollers (32, 33) mounted to the underside of the rear board at front and rear locations by a predetermined distance, a flexible connector (52) having a predetermined length and connected at opposite ends thereof to the front and rear boards to allow the front and rear boards to independently move within a predetermined range. A rotating center of each of the first and third rollers is spaced apart from an axis, having a predetermined inclination angle with respect to undersides of the respective boards, by a predetermined distance.

15 Claims, 7 Drawing Sheets

[Fig. 1]
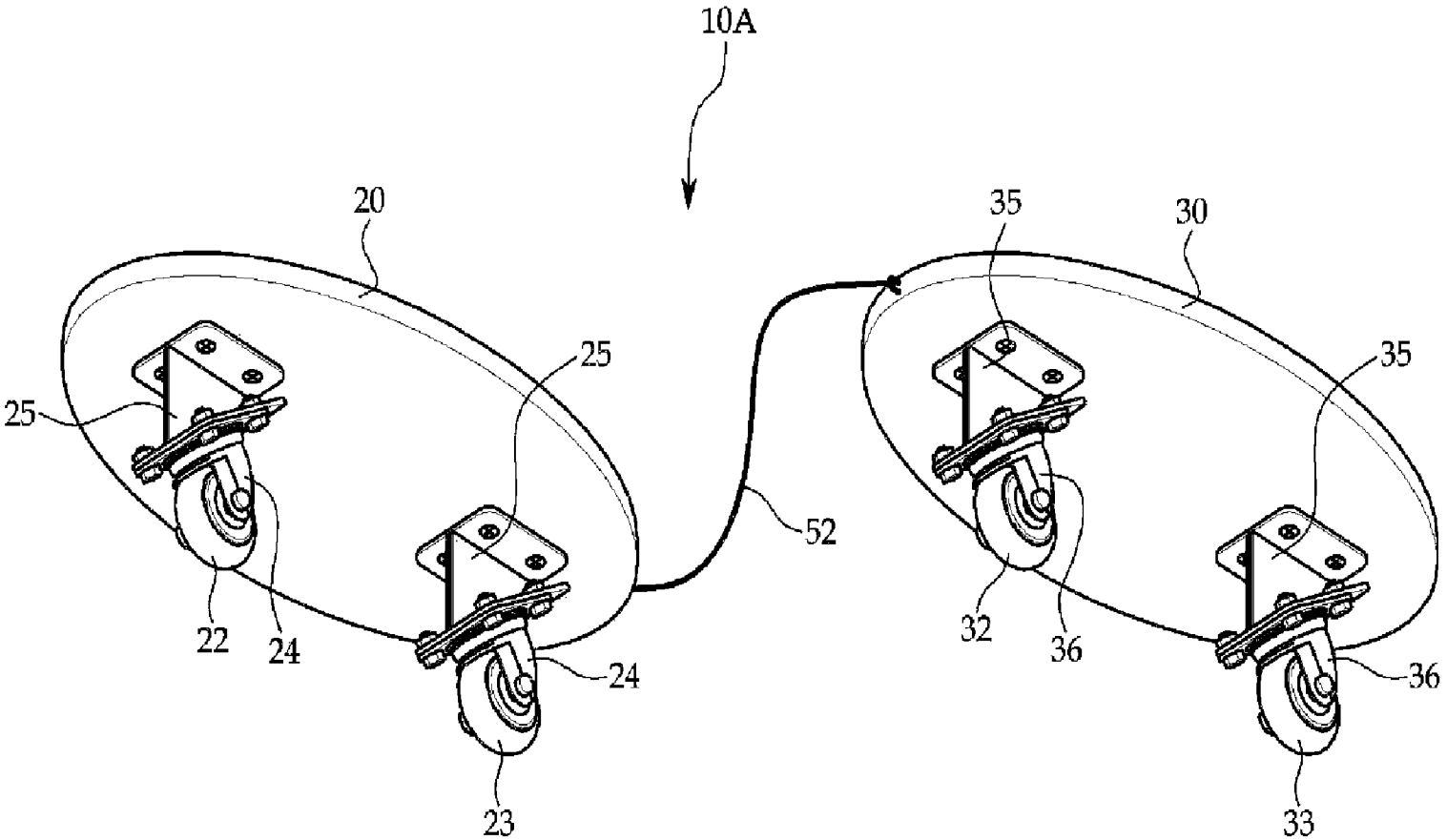

[Fig. 2]
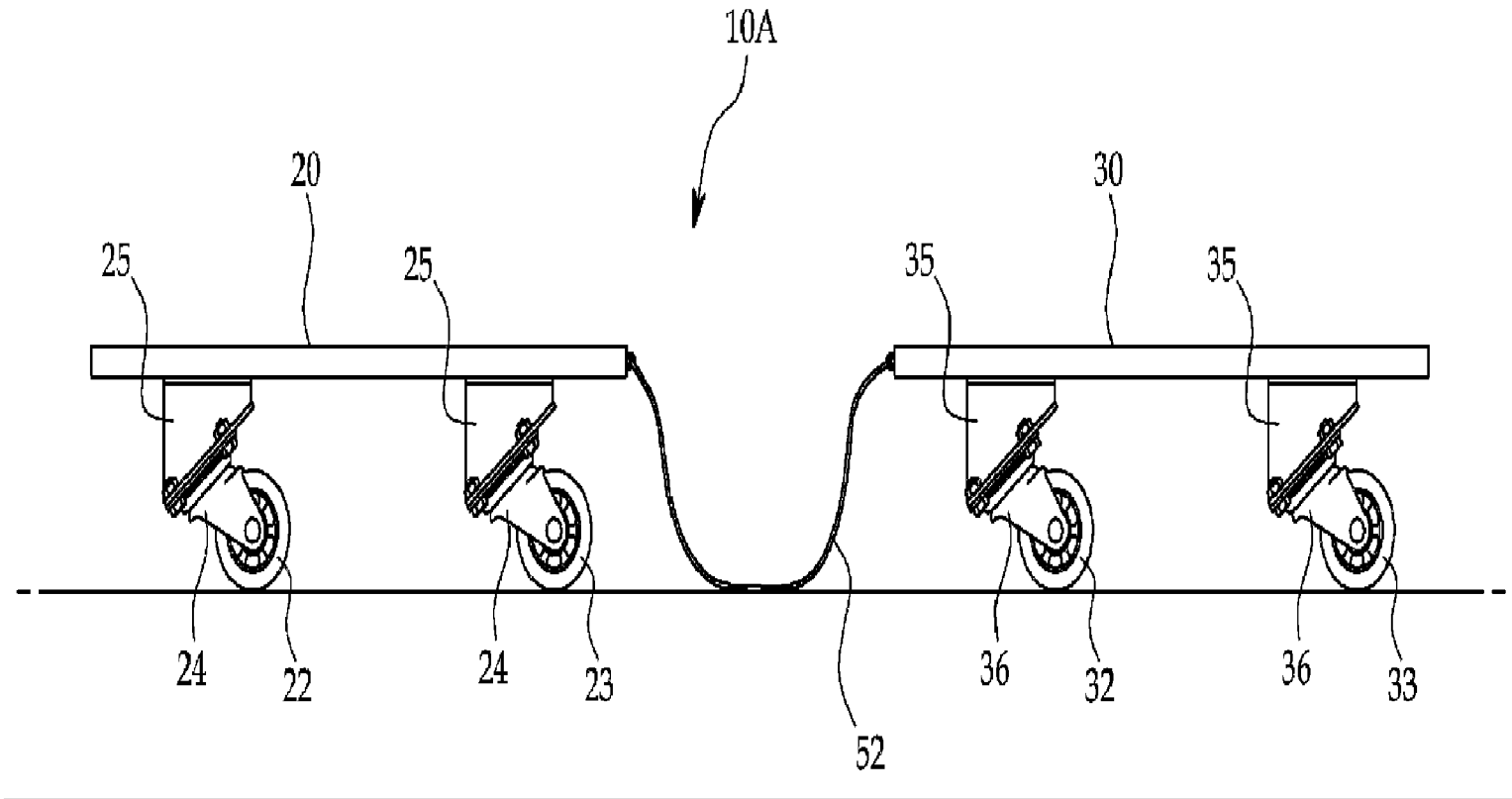

[Fig. 3]
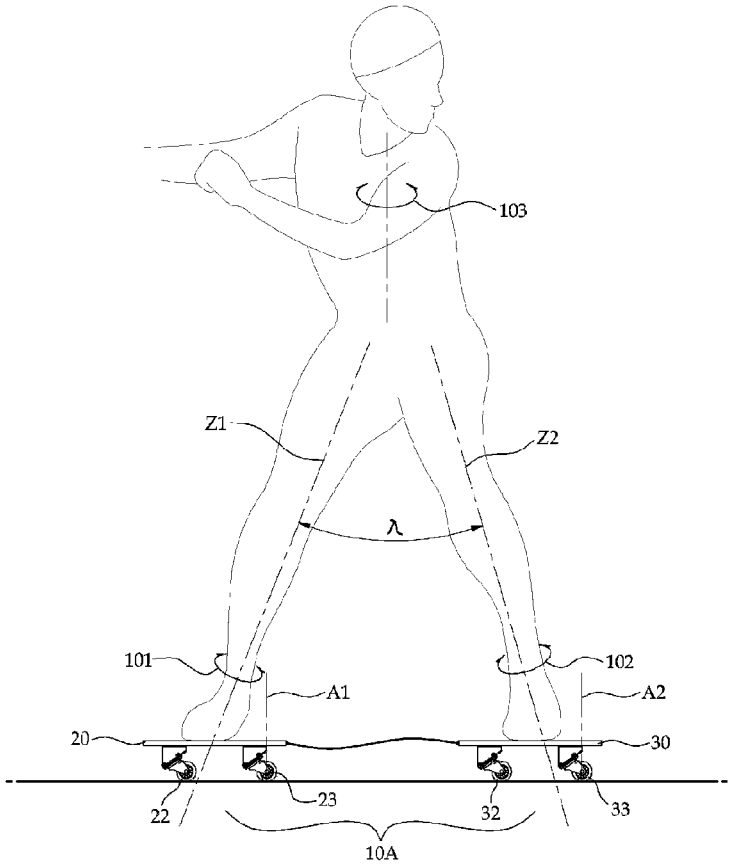
[Fig. 4]
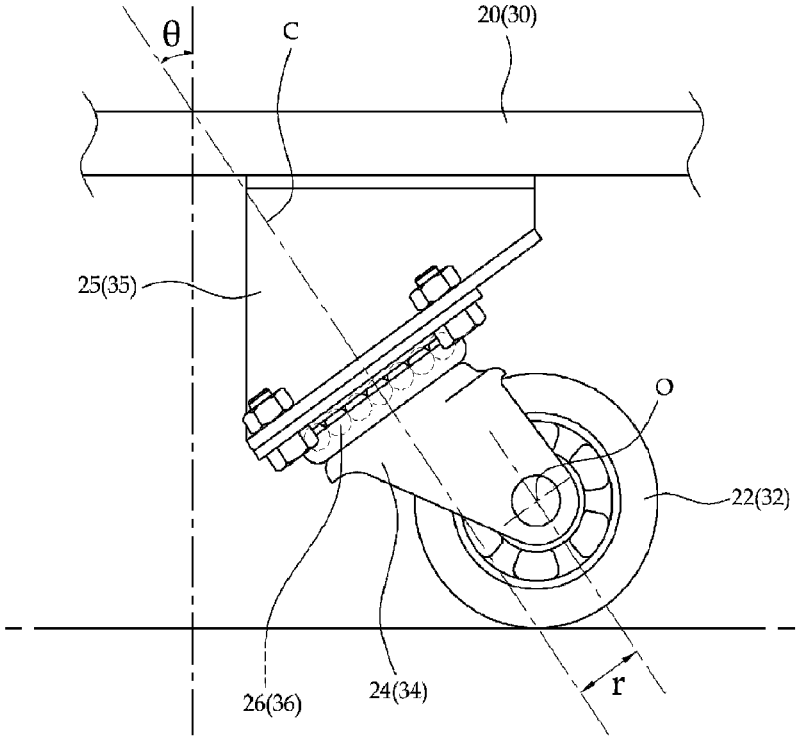

[Fig. 5]
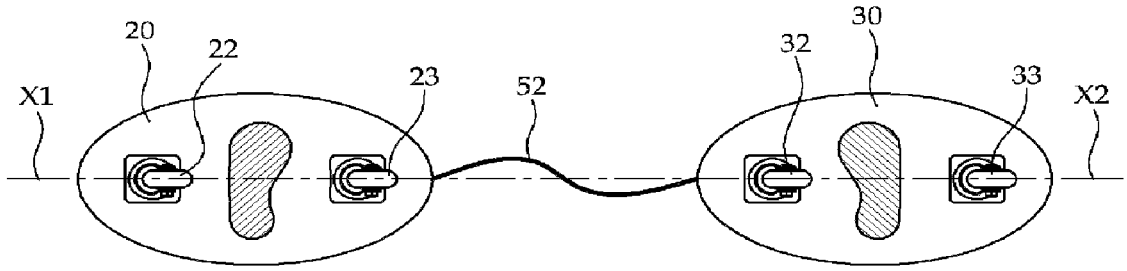
(A)
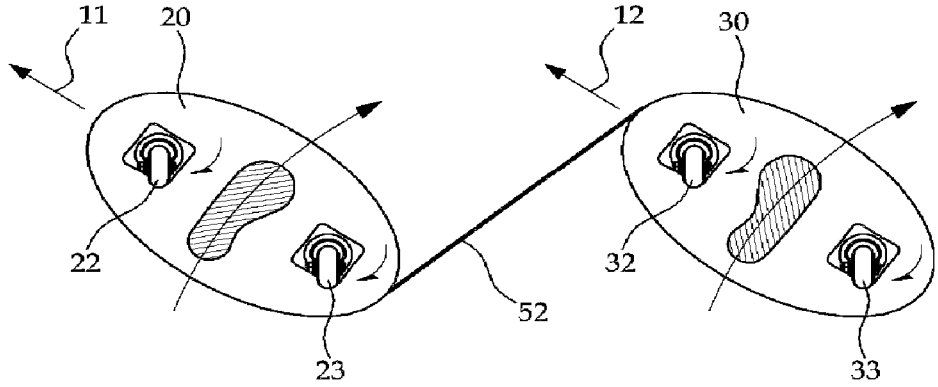
(B)
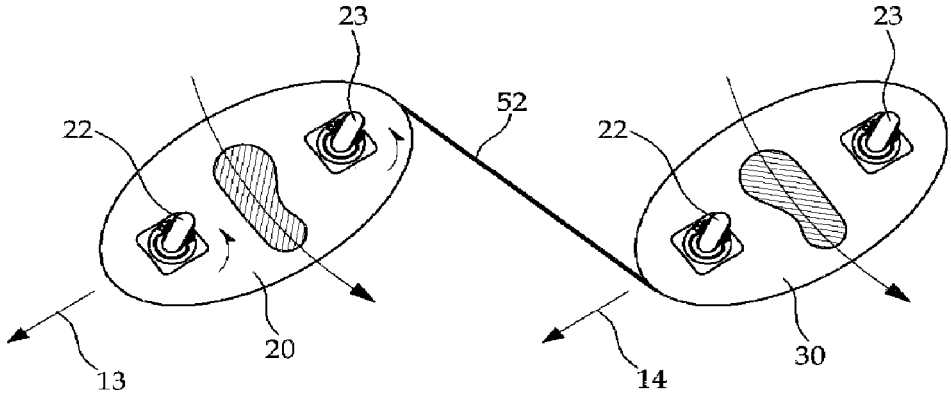
(C)

[Fig. 6]
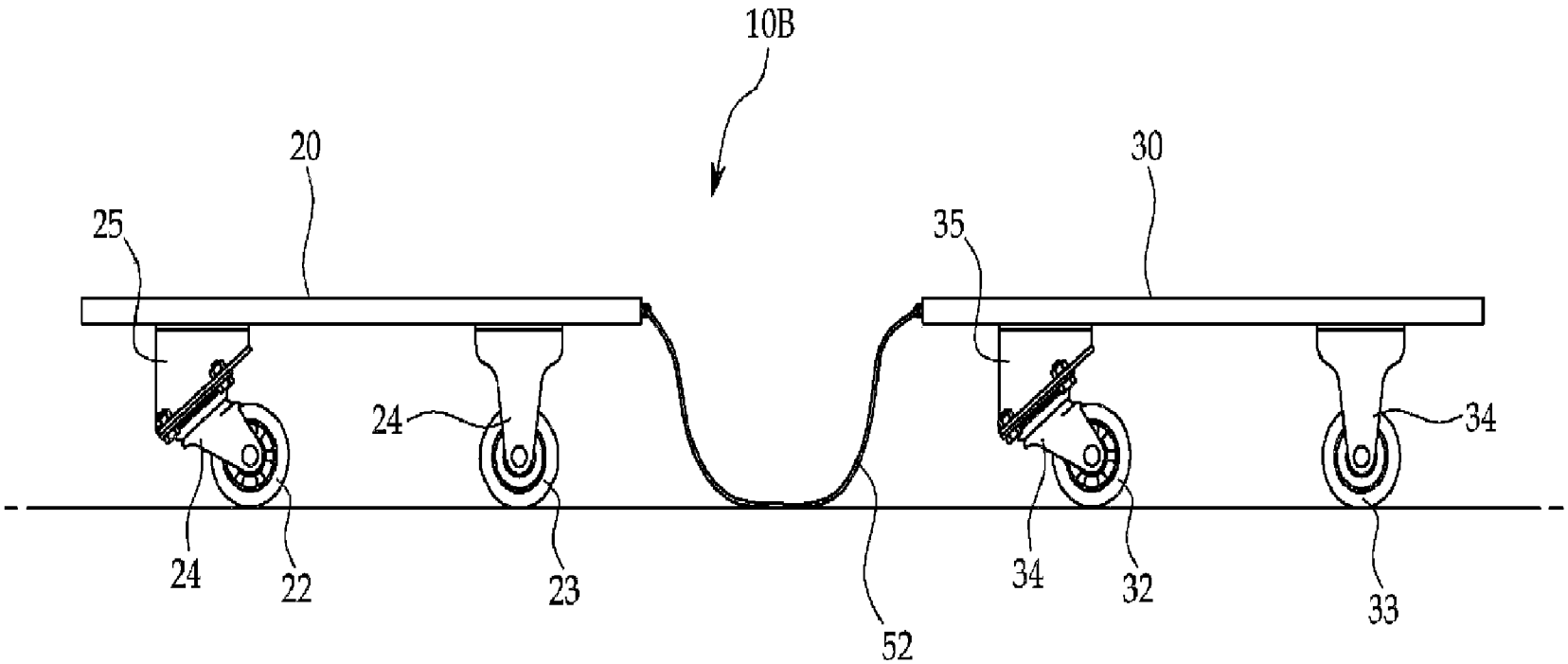

[Fig. 7]
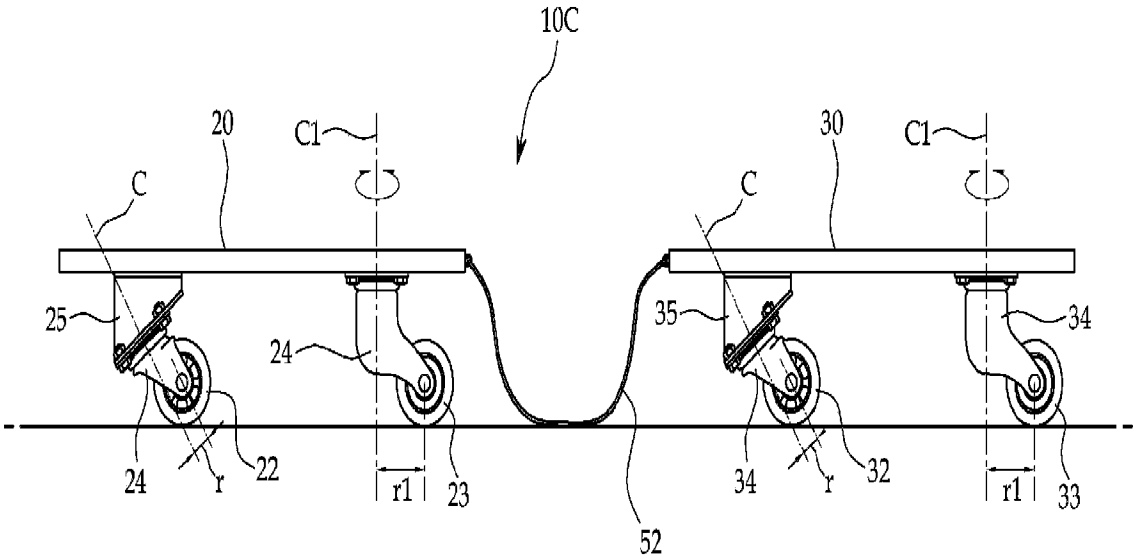
[Fig. 8]
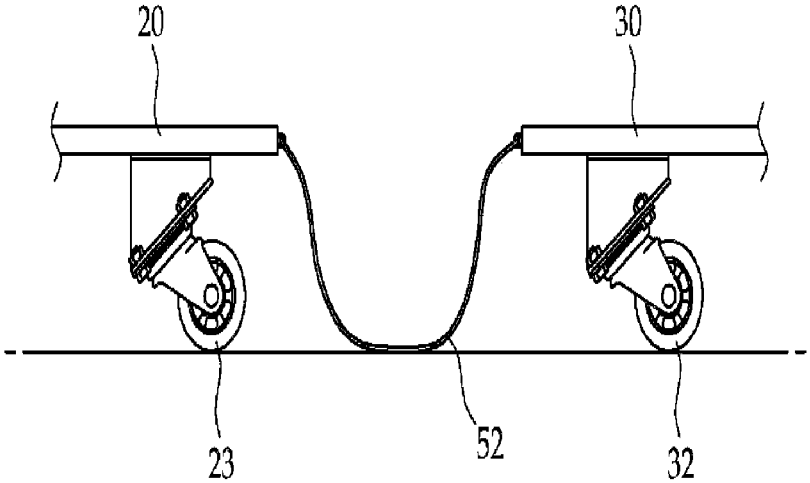

[Fig. 9]
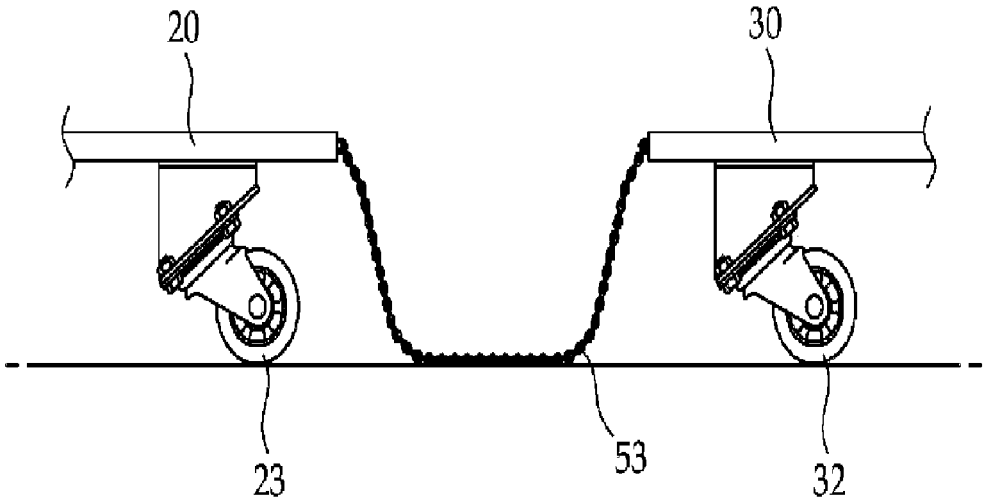
[Fig. 10]
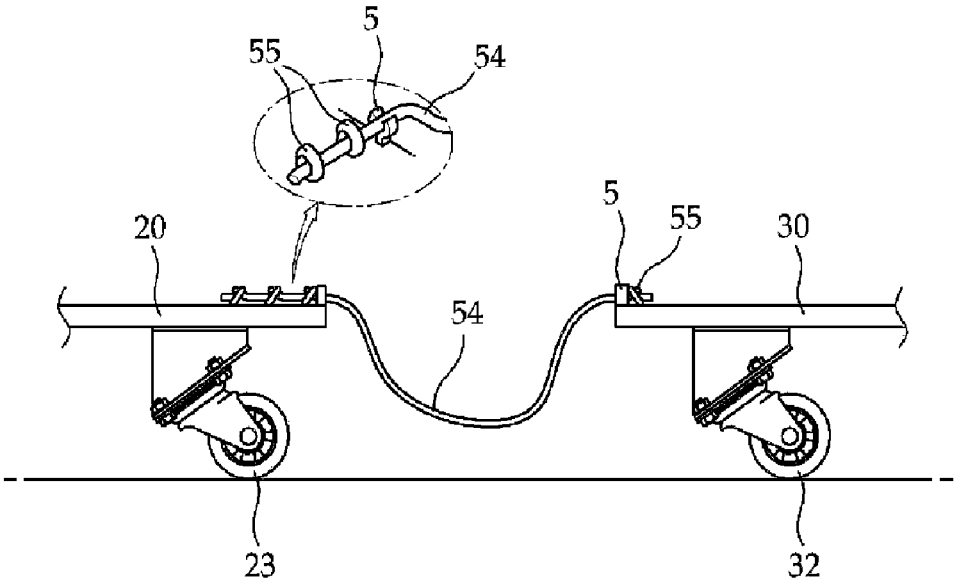

CASTER SKATE APPARATUS

TECHNICAL FIELD

The present invention relates to a caster skate apparatus which can achieve easy propulsion and change in the direction of travel as a rider twists his/her ankles or turns his/her body to the right and left, thereby increasing the enjoyment of the rider.

BACKGROUND ART

As a representative example of sporting goods wherein a rider places both feet on the board deck while coasting and maneuvering, skateboards are well known.

Now, considering the basic configuration of a conventional skateboard, it includes an elongated oval deck having an area to place both feet thereon, and a pair of rollers rotatably mounted on the underside of the deck at front and rear locations, so that they can roll along the ground.

Disadvantages associated with the conventional skateboard include the fact that the skateboard rider has to push the ground with one foot to achieve additional speed or propulsion when the propulsion of the skateboard is achieved by the rolling of the rollers on the ground. Also, the skateboard inevitably requires a large turning radius when changing the direction of travel or making a U-turn. This results in the need of a large riding space and the rider derives no pleasure from being able to perform delicate movements while riding.

As a solution to improve the conventional propulsion method using the rider's pushing, Korean Patent Registration No. 10-0394848 discloses a skateboard with direction-casters.

The disclosed skateboard comprises a pair of front and rear boards and a connecting element for holding one board at each end and maintaining a predetermined distance between both the boards. At least one of the two boards includes one or more direction-casters attached to the underside thereof. The connecting element is made of an elastic material, so that the connecting element can restore its original shape as soon as any twisting or bending force, applied thereto, is removed.

In operation, in a riding stance with one foot on the front board and the other foot on the rear board, the skateboard rider obtains a propulsive force by alternately leaning both feet to one side or the other side based on a twisting motion of the elastic connecting element. Whenever the rider alternately leans both feet to one side or the other side, the direction-casters rotate back and forth about their respective axes by a predetermined rotating angle. In this case, the components of force of the direction-casters generate a propulsive force which propels the skateboard.

The above-described prior art, however, has the following several problems due to the fact that the two boards are interconnected by use of the elastic element.

Firstly, the two boards, bound with each other via the elastic element, require a large turning radius to change the direction of travel to the left and right or to make a U-turn. Accordingly, changing the direction of travel of the boards has the need of a large space and cannot be rapidly performed. This may be a factor of making the skateboard less safe to use.

Secondly, such a large turning radius as mentioned above makes it impossible for the skateboard rider to delicately maneuver the skateboard.

Thirdly, once the rider places both feet on the two boards, there is no change in the relative positions of feet. Thus, the skateboard provides less exercise than the present invention.

Fourthly, the prior art skateboard has a fixed length. In this case, the skateboard may often be unsuitable for the rider's body size. For example, the skateboard may be too big for small-sized people or too small for large-sized people to conveniently maneuver the skateboard.

DISCLOSURE OF INVENTION

Technical Problem

Therefore, the present invention has been made in view of the above problems, and it is an object of the present invention to provide a caster skate apparatus in which two boards, for supporting both feet of a rider thereon, can move independently while maintaining a predetermined distance therebetween, whereby the boards can achieve a high propulsive force from independent movements of rollers and can easily make turns with a small turning radius.

Technical Solution

In accordance with a first aspect of the present invention, the above and other objects can be accomplished by the provision of a caster skate apparatus which is propelled in a direction changeable manner by use of both feet of a rider for providing the rider with exercise effect, comprising: a front board to support one foot thereon; first and second rollers mounted to the underside of the front board by a predetermined distance while being aligned in series at front and rear locations along a center axis, to perform rolling motions on the ground; a rear board arranged at the rear side of the front board to support the other foot thereon; third and fourth rollers mounted to the underside of the rear board by a predetermined distance while being aligned in series at front and rear locations along a center axis, to perform rolling motions on the ground; and a flexible connector having a predetermined length, one end of the flexible connector being connected to a rear end of the front board, and the other end of the flexible connector being connected to a front end of the rear board, so that both the front and rear boards are able to independently move within a predetermined range, wherein a rotating center of each of the first and third rollers is spaced apart from an axis, having a predetermined inclination angle with respect to undersides of the respective boards, by a predetermined distance.

In accordance with a second aspect of the present invention, the above and other objects can be accomplished by the provision of a caster skate apparatus which is propelled in a direction changeable manner by use of both feet of a rider for providing the rider with exercise effect, comprising: a front board to support one foot thereon; first and second rollers mounted to the underside of the front board by a predetermined distance while being aligned in series at front and rear locations along a center axis, to perform rolling motions on the ground; a rear board arranged at the rear side of the front board to support the other foot thereon; third and fourth rollers mounted to the underside of the rear board by a predetermined distance while being aligned in series at front and rear locations along a center axis, to perform rolling motions on the ground; and a flexible connector having a predetermined length, one end of the flexible connector being connected to a rear end of the front board, and the other end of the flexible connector being connected to a front end of the rear board, so that both the front and rear boards are able to independently move within a predetermined range, wherein a rotating center of each of the first and third rollers is spaced apart from an axis, having a predetermined inclination angle with respect to undersides of the respective boards, by a predetermined radius, and wherein a rotating center of each of the second and fourth rollers is spaced apart from a rear rotating axis, which is perpendicular to the undersides of the respective boards, by a predetermined distance.

In accordance with a third aspect of the present invention, the above and other objects can be accomplished by the provision of a caster skate apparatus which is propelled in a direction changeable manner by use of both feet of a rider for providing the rider with exercise effect, comprising: a front board to support one foot thereon; first and second rollers mounted to the underside of the front board by a predetermined distance while being aligned in series at front and rear locations along a center axis, to perform rolling motions on the ground; a rear board arranged at the rear side of the front board to support the other foot thereon; third and fourth rollers mounted to the underside of the rear board by a predetermined distance while being aligned in series at front and rear locations along a center axis, to perform rolling motions on the ground; and a flexible connector having a predetermined length, one end of the flexible connector being connected to a rear end of the front board, and the other end of the flexible connector being connected to a front end of the rear board, so that both the front and rear boards are able to independently move within a predetermined range, wherein a rotating center of each of the first to fourth rollers is spaced apart from an axis, having a predetermined inclination angle with respect to undersides of the respective boards, by a predetermined distance.

Preferably, the connector may be a flexible wire rope.

Preferably, the connector may be a chain formed by interconnecting a plurality of rings.

Preferably, the connector may be a steel wire.

Preferably, the connector may be provided with length-adjustment members to adjust the distance between the two boards.

ADVANTAGEOUS EFFECTS

The caster skate apparatus of the present invention has the following effects.

Firstly, the caster skate apparatus comprises a pair of boards interconnected by means of a flexible connector. In this case, both the boards can move independently by virtue of the flexible connector, to be repeatedly turned to the right and left. Accordingly, as the rider twists his/her ankles or turns his/her body to the right and left, the boards can be propelled with the ability to easily change direction by use of a propulsive force obtained in accordance with the rotating and rolling motions of rollers mounted on the undersides of the boards.

Secondly, the overall length of the connector is adjustable within a predetermined maximum value. This allows the rider to maneuver the caster skate apparatus more delicately, and to make a turn within a small turning radius. Therefore, the rider can ride the caster skate apparatus even in a narrow space and providing more exercise.

Thirdly, since the length adjustable connector enables the distance between the two boards to be adjusted within a predetermined range, the overall size of the caster skate apparatus can be adjusted to suit the body size of the rider.

Fourthly, the boards, interconnected by means of the flexible connector, are able to be conveniently folded, resulting in good portability.

Fifthly, as compared to the above-described prior art wherein two boards are inter-connected by means of an elastic element, the caster skate apparatus of the present invention can achieve a reduction in the turning radius of the boards, enabling delicate cornering maneuvers. Further, since the rider has to repeatedly change the relative positions of both feet placed on the two boards while maneuvering, the caster skate apparatus of the present invention can provide serious exercise.

BRIEF DESCRIPTION OF THE DRAWINGS

The above and other objects, features, and other advantages of the present invention will be more clearly understood from the following detailed description taken in conjunction with the accompanying drawings, in which:

FIG. 1 is a bottom perspective view illustrating a caster skate apparatus in accordance with a first embodiment of the present invention;

FIG. 2 is a front view of FIG. 1A;

FIG. 3 is a view illustrating the use of the caster skate apparatus in accordance with the first embodiment of the present invention;

FIG. 4 is a partial enlarged view illustrating a roller mounted to the caster skate apparatus in accordance with the present invention;

FIGS. 5A to 5C are views illustrating the layout of rollers of the caster skate apparatus in accordance with the first embodiment of the present invention, FIG. 5A illustrating the orientation of boards in an initial riding state, and FIGS. 5B and 5C illustrating different orientations of boards when making a right-turn and a left-turn, respectively;

FIG. 6 is a front view illustrating a caster skate apparatus in accordance with a second embodiment of the present invention;

FIG. 7 is a front view illustrating a caster skate apparatus in accordance with a third embodiment of the present invention; and FIGS. 8, 9, and 10 are partial front views illustrating alternative examples of a connector for use in the caster skate apparatus in accordance with the present invention.

MODE FOR THE INVENTION

Now, preferred embodiments of the present invention will be explained in detail with reference to the accompanying drawings.

FIGS. 1 and 2 illustrate a caster skate apparatus 10A in accordance with a first embodiment of the present invention. FIG. 3 is a view illustrating the use of the caster skate apparatus in accordance with the present invention. As shown in FIG. 3, the caster skate apparatus 10A is designed to be propelled as a rider turns his/her body to the right and left. In this case, both legs of the rider serve as rotating axes Z1 and Z2. The caster skate apparatus 10A is also able to change the direction of travel easily. Thus, the caster skate apparatus 10A of the present invention effectively increases the enjoyment of the rider.

As shown in FIGS. 1 and 2, the caster skate apparatus 10A comprises: a front board 20 to support one foot thereon; a rear board 30 arranged at the rear side of the front board 20 to support the other foot thereon; and a flexible connector having a predetermined length. One end of the flexible connector is connected to a rear end of the front board 20, and the other end is connected to a front end of the rear board 30, so that both the front and rear boards 20 and 30 can move independently while maintaining a predetermined distance therebetween. The caster skate apparatus 10A of the present invention further comprises: first and second rollers 22 and 23 mounted to the underside of the front board 20 by a predetermined distance; and third and fourth rollers 32 and 33 mounted to the underside of the rear board 30 by a predetermined distance. The first and second rollers 22 and 23 and the third and fourth rollers 32 and 33 are aligned in series at front and rear locations of the respective boards 20 and 30 along center axes X1 of the boards 20 and 30, to perform rolling motions on the ground.

To obtain a high propulsive force required to propel the boards 20 and 30 and to easily make a left-turn or right-turn thereof, as shown in FIG. 4, each of the first roller 22 and the third roller 32 has a rotating center O, which is spaced apart from an axis C having a predetermined inclination angle θ with respect to the undersides of the respective boards 20 and 30, by a predetermined distance r. Thus, each of the first and third rollers 22 and 32 is adapted to rotate about the inclined axis C while simultaneously rotating about the rotating center O thereof.

The predetermined inclination angle 0 of the axis C of the rollers 22 and 32 provides the rollers 22 and 32 with a braking force when the rollers 22 and 32 reach their rotation limits. Preferably, the inclination angle θ may be determined in a range of 25° to 45°. If the predetermined inclination angle θ is more than 45°, it makes the rollers 22 and 32 difficult to generate a propulsive force. Conversely, if the predetermined inclination angle θ is less than 25°, the rollers 22 and 32 are impossible to obtain a required braking force.

As shown in FIG. 4, the first and third rollers 22 and 32 are connected to lower ends of oblique arms 24 and 34, respectively. Upper ends of the arms 24 and 34 are connected to brackets 25 and 35 to rotate about the axis C, respectively. Ball bearings 26 and 36 are interposed between the arm 24 and the bracket 25 and between the arm 34 and the bracket 35, respectively, to reduce the generation of friction when the arms 24 and 34 rotate. Accordingly, the arms 24 and 34 are rotatably mounted by the use of the ball bearings 26 and 36.

With the above-described roller mounting arrangement, whenever the boards 20 and 30 are turned to the right and left as shown in FIGS. 5B and 5C, the first and third rollers 22 and 32 are able to change the direction of travel. Also, the boards 20 and 30 are adapted to obtain a propulsive force as they are repeatedly raised and lowered.

If the rider twists his/her ankles (or body) to the right and left about axes A1 and A2 of the second and fourth rollers 23 and 33 as shown in FIG. 3, the respective boards 20 and 30, which are being propelled, perform rotating motions by a predetermined rotating angle. Here, the axes A1 and A2 are aligned based on ground points where the second and fourth rollers 23 and 33 come into contact with the ground.

In the present invention, the second and fourth rollers 23 and 33 may be modified in shape, as shown in FIGS. 6 and 7.

FIG. 6 illustrates a caster skate apparatus 10B in accordance with a second embodiment of the present invention. In the second embodiment, the second and fourth rollers 23 and 33 are fixedly mounted to the respective boards 20 and 30 by interposing linear arms 24B and 34B, respectively, to perform rolling motions on the ground.

FIG. 7 illustrates a caster skate apparatus 10C in accordance with a third embodiment of the present invention. In the third embodiment, the second and fourth rollers 23 and 33 are spaced apart from rear rotating axes C1 of the respective boards 20 and 30 by a predetermined distance r1 through the use of bent arms 24C and 34C, to perform rolling motions on the ground. In this case, the ball bearings are also mounted around the rotating axes C1 in the same manner as FIG. 4.

Meanwhile, the connector, for interconnecting the front board 20 and the rear board 30, is selected from among members having a desired flexibility. For example, the connector may be a wire rope 52 having an appropriate diameter as shown in FIG. 8, or may be a chain 53 consisting of a plurality of rings as shown in FIG. 9. Alternatively, the connector may be another steel wire. Here, the desired flexibility of the connector is determined so that the connector is difficult to extend in a longitudinal extension, but is easy to be twisted or flexibly contracted in a longitudinal direction.

The connector employed in the present invention allows the two boards 20 and 30 to independently move while maintaining a predetermined distance therebetween. Also, the connector serves to limit the maximum straddle angle λ between both feet of the rider placed on the boards 20 and 30.

When the front and rear boards 20 and 30 are propelled forward by the use of the propulsive force obtained as the boards 20 and 30 are simultaneously turned to the right and left, the connector allows the independent parallel motions of the boards 20 and 30.

In the present invention, the connector may be provided with length-adjustment members, to adjust the distance between the two boards 20 and 30. FIG. 10 illustrates an example of the length-adjustment members. In FIG. 10, the steel wire 54 is provided with a plurality of knot-shaped lockers 55. In this case, correspondingly, two connection loops 5 are provided at a rear end of the front board 20 and a front end of the rear board 30, respectively. Thereby, the lockers 55 of the wire rope 52 are adapted to be caught by the connection loops 5 of the front and rear boards 20 and 30.

Now, the operation of the caster skate apparatus having the above-described configuration will be explained based on the first embodiment of the present invention wherein each of the respective rollers 22, 23, 32, and 33 is mounted to rotate about the axis C having the predetermined inclination angle θ at a position spaced apart from the axis C by the predetermined distance r.

First, after placing one foot on the front board 20 and the other foot on the rear board 30 as shown in FIG. 3, the rider slightly shifts the center of his/her body rearward, and twists his/her ankles in directions indicated by arrows 101 and 102. In this case, the distance between both the boards 20 and 30 is limited in accordance with the operation of the connector 52 or 53. In particular, when the connector is the flexible wire rope 52, it ensures the free movement of both feet on the boards 20 and 30 to some extent.

As the rider twists his/her ankles to the right and left, the first, second, third, and fourth rollers 22, 23, 32, and 33 perform rotating motions by a predetermined rotating angle while simultaneously performing rolling motions, as shown in FIGS. 5B and 5C.

For example, when the boards 20 and 30 are turned to the left as shown in FIG. 5C, the first, second, third, and fourth rollers 22, 23, 32, and 33 rotate counterclockwise. Conversely, when the boards 20 and 30 are turned to the right as shown in FIG. 5B, the first, second, third, and fourth rollers 22, 23, 32, and 33 rotate clockwise.

Accordingly, when the rider pulls one of the boards, for example, the front board 20, with one foot, the rollers 22 and 23 face the pulled direction. Conversely, when the rider pushes the front board 20, the rollers 22 and 23 face the pushed direction. As the pulling and pushing operations are repeated, the boards 20 and 30 are moved leftward and rightward to thereby be propelled in directions indicated by arrows 11, 12, 13, and 14 of FIG. 4. In this case, the rotating angles of the first and third rollers 22 and 32 are larger than the rotating angles of the second and fourth rollers 23 and 33.

As stated above, the propulsion of the caster skate apparatus according to the present invention is achieved as the first, second, third, and fourth rollers 22, 23, 32, and 33 continuously perform rotating and rolling motions and by the use of the height variation of the boards 20 and 30. Accordingly, the speed of traveling and the strength of the propulsive force are determined by how fast the rider twists his/her ankles or turns his/her body to the right and left.

For this reason, when the rider propels the caster skate apparatus in a riding stance with one foot on the front board 20 and the other foot on the rear board 30, the rider takes a twist-dancing posture while turning his/her legs including the ankles (or body) to the right and left.

During the propulsion of the caster skate apparatus, the second and fourth rollers 23 and 33 operate in the same manner as the first and third rollers 22 and 32 although they exhibit a smaller rotating angle than the first and third rollers 22 and 32. Thus, the second and fourth rollers 23 and 33 also act to lead the independent parallel movements of both the boards 20 and 30.

In consideration of the fact that the second and fourth rollers 23 and 33 serve as reference rollers and the first and third rollers 22 and 32 serves as direction indicator rollers, the rider has to place both feet at locations close to the second and fourth rollers 23 and 33, in order to easily change the direction of travel.

Also, in the present invention, since both the separate boards 20 and 30 are connected by use of the flexible connector, the caster skate apparatus is able to easily pass through a narrow space. That is, the flexible connector allows for the independent movements of both the boards 20 and 30. Accordingly, the rider can turn the boards 20 and 30 to the right and left or make a U-turn within a small turning radius while achieving his/her delicate maneuvering operation.

If the rider places one foot to face a target traveling direction and the other foot in a slightly oblique state when turning to the right and left or making a U-turn, both the feet tend to push each other. Thus, one of the boards, on which one the oblique foot is placed, is affected by a braking force, so that the board reduces in speed. This allows the rider to easily change the direction of travel.

In the present invention, the boards 20 and 30 are propelled by use of the twisting motions of the rider's ankles rather than the pushing motions of both feet. This is a factor in improving the ability to easily change the direction of travel of the caster skate apparatus.

Meanwhile, the distance between the boards 20 and 30 can be easily adjusted by adjusting the length of the connector. Accordingly, the overall size of the caster skate apparatus can be adjusted to suit the body size of the rider.

In a state wherein the connector is removed to separate the boards 20 and 30 from each other, as will be easily expected, the rider may utilize the boards 20 and 30 as another type of sledding tool along with poles.

INDUSTRIAL APPLICABILITY

As apparent from the above description, the caster skate apparatus of the present invention has the following effects.

Firstly, according to the present invention, the caster skate apparatus comprises a pair of boards interconnected by means of a flexible connector. In this case, both the boards can move independently by virtue of the flexible connector, to be repeatedly turned to the right and left. Accordingly, as the rider twists his/her ankles or turns his/ her body to the right and left, the boards can be propelled with the ability to easily change direction by use of a propulsive force obtained in accordance with the rotating and rolling motions of rollers mounted on the undersides of the boards.

Secondly, according to the present invention, the overall length of the connector is adjustable within a predetermined maximum value. This allows the rider to maneuver the caster skate apparatus more delicately, and to make a turn within a small turning radius. Therefore, the rider can ride the caster skate apparatus even in a narrow space and providing more exercise.

Thirdly, since the length adjustable connector enables the distance between the two boards to be adjusted within a predetermined range, the overall size of the caster skate apparatus can be adjusted to suit the body size of the rider.

Fourthly, the boards, interconnected by means of the flexible connector, are able to be conveniently folded, resulting in good portability.

Fifthly, as compared to the above-described prior art wherein two boards are interconnected by means of an elastic element, the caster skate apparatus of the present invention can achieve a reduction in the turning radius of the boards, enabling delicate cornering maneuvers. Further, since the rider has to repeatedly change the relative positions of both feet placed on the two boards while maneuvering, the caster skate apparatus of the present invention can provide serious exercise.

Although the preferred embodiments of the present invention have been disclosed for illustrative purposes, those skilled in the art will appreciate that various modifications, additions and substitutions are possible, without departing from the scope and spirit of the invention as disclosed in the accompanying drawings.

The invention claimed is:

1. A caster skate apparatus which is propelled in a direction changeable manner by use of both feet of a rider for providing the rider with exercise effect, comprising:

a front board to support one foot thereon;

first and second rollers mounted to the underside of the front board by a predetermined distance while being aligned in series at front and rear locations along a center axis, to perform rolling motions on the ground;

a rear board arranged at the rear side of the front board to support the other foot thereon;

third and fourth rollers mounted to the underside of the rear board by a predetermined distance while being aligned in series at front and rear locations along a center axis, to perform rolling motions on the ground; and a flexible connector having a predetermined length, one end of the flexible connector being connected to a rear end of the front board, and the other end of the flexible connector being connected to a front end of the rear board, so that both the front and rear boards are able to independently move within a predetermined range, wherein a rotating center of each of the first and third rollers is spaced apart from an axis, having a predetermined inclination angle with respect to undersides of the respective boards, by a predetermined distance.

2. A caster skate apparatus which is propelled in a direction changeable manner by use of both feet of a rider for providing the rider with exercise effect, comprising:

a front board to support one foot thereon;

first and second rollers mounted to the underside of the front board by a predetermined distance while being aligned in series at front and rear locations along a center axis, to perform rolling motions on the ground;

a rear board arranged at the rear side of the front board to support the other foot thereon;

third and fourth rollers mounted to the underside of the rear board by a predetermined distance while being aligned in series at front and rear locations along a center axis, to perform rolling motions on the ground; and a flexible connector having a predetermined length, one end of the flexible connector being connected to a rear end of the front board, and the other end of the flexible connector being connected to a front end of the rear board, so that both the front and rear boards are able to independently move within a predetermined range, wherein a rotating center of each of the first and third rollers is spaced apart from an axis, having a predetermined inclination angle with respect to undersides of the respective boards, by a predetermined radius, and wherein a rotating center of each of the second and fourth rollers is spaced apart from a rear rotating axis, which is perpendicular to the undersides of the respective boards, by a predetermined distance.

3. A caster skate apparatus which is propelled in a direction changeable manner by use of both feet of a rider for providing the rider with exercise effect, comprising:

a front board to support one foot thereon;

first and second rollers mounted to the underside of the front board by a predetermined distance while being aligned in series at front and rear locations along a center axis, to perform rolling motions on the ground;

a rear board arranged at the rear side of the front board to support the other foot thereon;

third and fourth rollers mounted to the underside of the rear board by a predetermined distance while being aligned in series at front and rear locations along a center axis, to perform rolling motions on the ground; and a flexible connector having a predetermined length, one end of the flexible connector being connected to a rear end of the front board, and the other end of the flexible connector being connected to a front end of the rear board, so that both the front and rear boards are able to independently move within a predetermined range, wherein a rotating center of each of the first to fourth rollers is spaced apart from an axis having a predetermined inclination angle with respect to undersides of the respective boards, by a predetermined distance.

4. The apparatus as set forth in claim 1, wherein the connector is a flexible wire rope.

5. The apparatus as set forth in claim 1, wherein the connector is a chain formed by interconnecting a plurality of rings.

6. The apparatus as set forth in claim 1, wherein the connector is a steel wire.

7. The apparatus as set forth in claim 1, wherein the connector is provided with length-adjustment members to adjust the distance between the two boards.

8. The apparatus as set forth in claim 2, wherein the connector is a flexible wire rope.

9. The apparatus as set forth in claim 2, wherein the connector is a chain formed by interconnecting a plurality of rings.

10. The apparatus as set forth in claim 2, wherein the connector is a steel wire.

11. The apparatus as set forth in claim 2, wherein the connector is provided with length-adjustment members to adjust the distance between the two boards.

12. The apparatus as set forth in claim 3, wherein the connector is a flexible wire rope.

13. The apparatus as set forth in claim 3, wherein the connector is a chain formed by interconnecting a plurality of rings.

14. The apparatus as set forth in claim 3, wherein the connector is a steel wire.

15. The apparatus as set forth in claim 3, wherein the connector is provided with length-adjustment members to adjust the distance between the two boards.

* * * * *